US005662156A

United States Patent [19]

Freeman

[11] Patent Number: 5,662,156

[45] Date of Patent: Sep. 2, 1997

[54] METHOD OF DIE CASTING MACHINE LUBRICATION WITH UNITIZED LUBRICANT

[76] Inventor: Lewis Gene Freeman, 1509 Pontiac Dr., Kokomo, Ind. 46902

[21] Appl. No.: 567,421

[22] Filed: Dec. 5, 1995

[51] Int. Cl.[6] ..... B22D 27/15; B22C 3/00

[52] U.S. Cl. ..... 164/61; 164/72; 164/113

[58] Field of Search ..... 164/72, 113, 267, 164/119, 61, 63, 65

[56] References Cited

U.S. PATENT DOCUMENTS

| | | | |
|---|---|---|---|
| 1,642,770 | 9/1927 | Drake . | |
| 2,561,360 | 7/1951 | Goss . | |
| 3,469,655 | 9/1969 | Moreno . | |
| 3,626,043 | 12/1971 | Flipot et al. . | |
| 3,686,013 | 8/1972 | Williams . | |
| 4,913,263 | 4/1990 | Spiers . | |
| 4,955,424 | 9/1990 | Takehisa et al. | 164/72 |
| 5,076,339 | 12/1991 | Smith | 164/72 |
| 5,401,546 | 3/1995 | Meattle . | |

FOREIGN PATENT DOCUMENTS

| | | | |
|---|---|---|---|
| 59-125255 | 7/1984 | Japan | 164/72 |

*Primary Examiner*—Joseph J. Hail, III
*Assistant Examiner*—L-H. Lin
*Attorney, Agent, or Firm*—Fildes & Outland, P.C.

[57] ABSTRACT

A method of lubricating a lubricant requiring portion of a die casting machine includes inserting a unitized lubricant element including flowable lubricant into a cylinder when an associated ram is retracted and advancing the ram against the lubricant element to squeeze the element against a partially closed end of the cylinder and force the lubricant to flow through a restricted passage to the portion to be lubricated. A metal injecting shot sleeve and plunger may act as the cylinder and ram for lubricant delivery prior to the introduction of molten casting metal where the die cavity is to be lubricated but provision of a separate cylinder and ram apparatus is preferred. Various forms of unitized lubricant elements with and without containers and examples of lubricant delivery apparatus are disclosed.

20 Claims, 7 Drawing Sheets

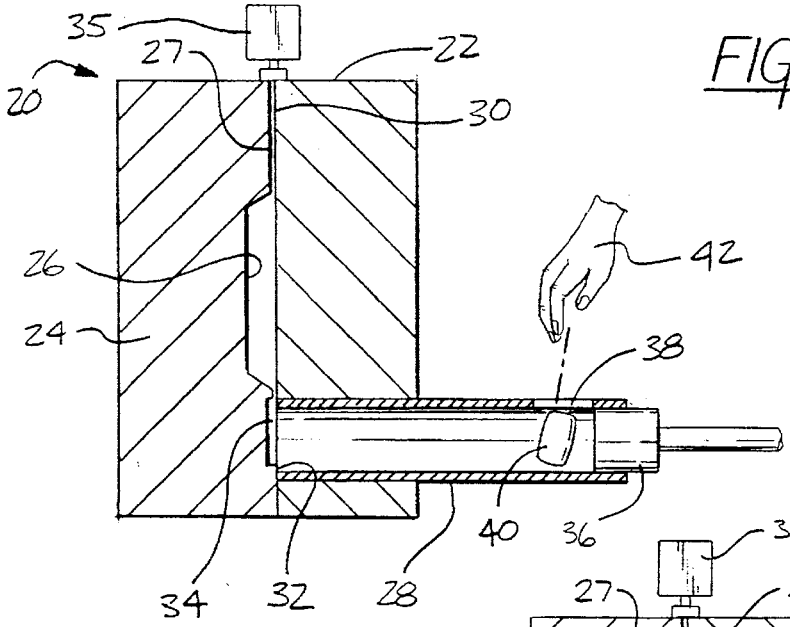
FIG-1
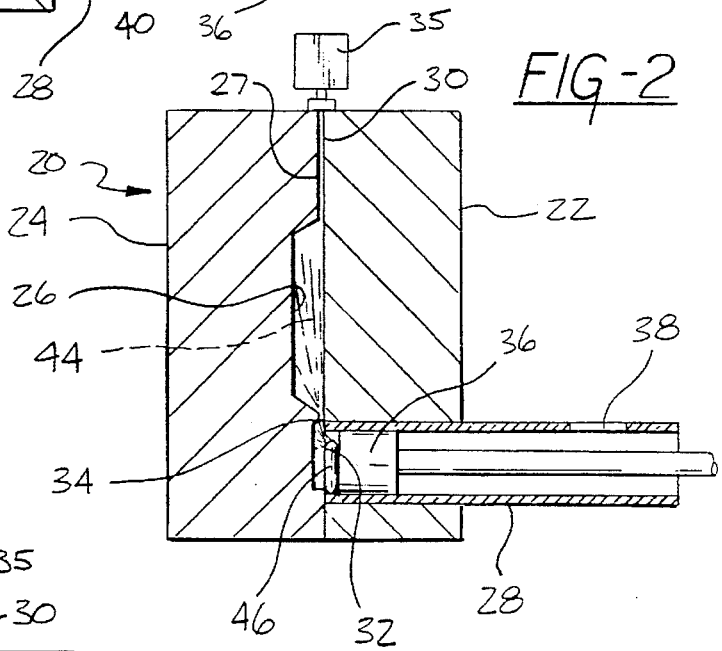
FIG-2
FIG-3
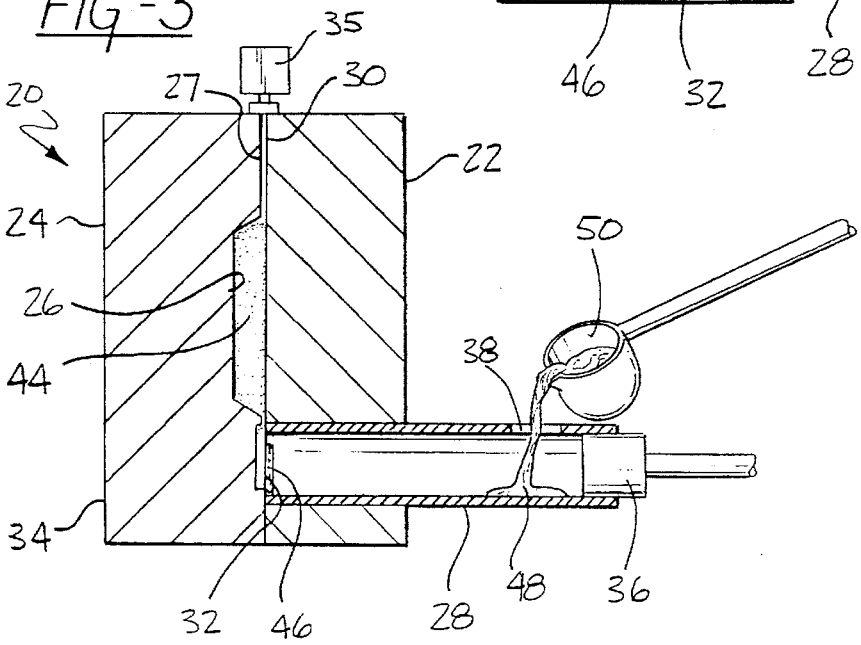

FIG - 7
PRIOR ART
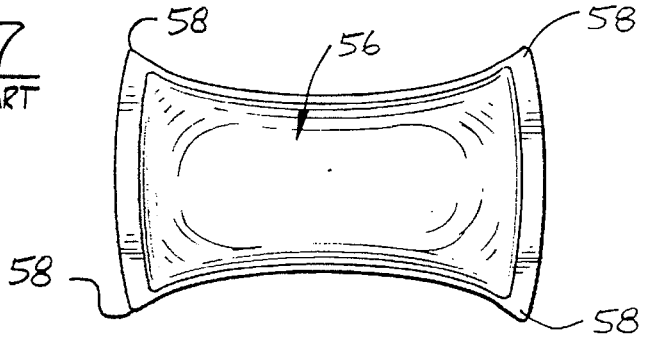
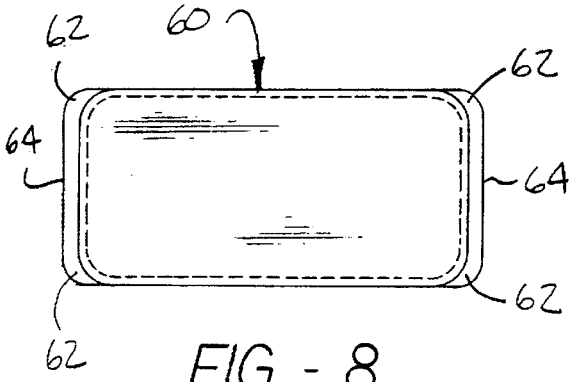
FIG - 8
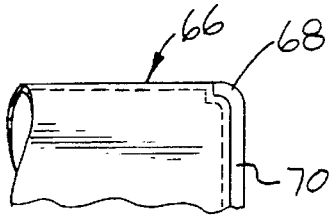
FIG - 9
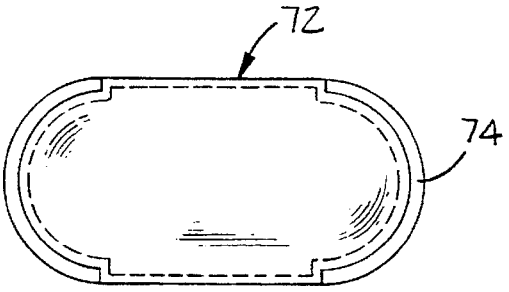
FIG - 10
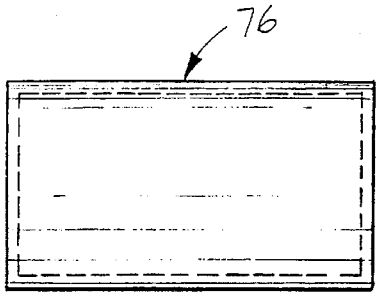
FIG - 11
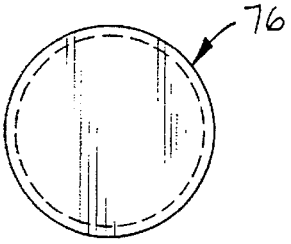
FIG - 12
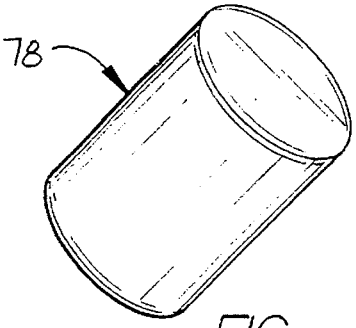
FIG - 13

METHOD OF DIE CASTING MACHINE LUBRICATION WITH UNITIZED LUBRICANT

FIELD OF THE INVENTION

This invention relates to the lubrication of die casting machines and, more particularly, to lubrication of a die cavity or other lubricant requiring portion using a unitized or packaged lubricant.

BACKGROUND OF THE INVENTION

For many years a primary method of applying lubricants or die release agents to the surfaces of a die casting die has been through spraying of a liquid carried lubricant onto the die cavity surfaces when the die pair is open. More recently, several forms of lubricating mechanisms or apparatus for use in conjunction with die casting machines have been proposed. These have included devices for introducing various forms of bulk lubricants into the die cavity or shot sleeve of the die casting machine as well as the application of a meltable lubricant into a shot sleeve for delivery to the die surfaces along with the molten casting metal. However, suitable methods and means for die lubrication with a unitized pelletized or packaged flowable lubricant delivered to a plunger or forced into a die cavity or shot sleeve prior to metal introduction remain undisclosed.

SUMMARY OF THE INVENTION

The present invention provides, for die casting machines, a method of die lubrication using a unitized lubricant in various forms. In a preferred embodiment, liquid or flowable semi-solid lubricant is packaged in a container to form a unitized lubricant element. In another form, a unitized lubricant pellet, made from lubricating material that is flowable under pressure, forms the lubricant element.

In its general form, the method of die casting machine lubrication contemplates introduction of a unitized lubricant element into a cylinder that is connected with a lubricant requiring portion, such as a plunger, a shot sleeve or a die cavity, by a restricted passage. The lubricant element is compressed in the cylinder by a ram which forces the lubricant to spray, or flow rapidly, into the die cavity, or other lubricant requiring portion, to coat the portion with the liquified or liquid lubricant. In preferred embodiments, the cylinder and ram are formed by separate apparatus associated with the casting dies. However, the lubricant may, alternatively, be introduced into the shot sleeve, which acts as the cylinder, and compressed by the plunger, which acts as the ram of the present method.

Accordingly, the general form of the invention provides a method of lubricating a die casting machine having a die cavity formed in and separable at a parting line between cover and ejector dies movable between closed and open die positions, the machine having unitized lubricant delivery means including a cylinder and a restricted passage connecting a partially closed end of the cylinder with a lubricant requiring portion of said machine, and a ram in the cylinder and reciprocable between a first position near the end and a second position spaced from the end, the method characterized by:

inserting a unitized lubricant element including flowable lubricant into the cylinder when the ram is retracted; and advancing the ram to the first position and against the lubricant element to squeeze the element against the end of the cylinder and force the lubricant to flow through the restricted passage to said lubricant requiring portion.

These and other features and advantages of the invention will be more fully understood from the following description of certain exemplary embodiments of the invention taken together with the accompanying drawings.

BRIEF DESCRIPTION OF THE DRAWINGS

In the drawings:

FIG. 1 is a schematic cross-sectional view of a conventional die casting machine illustrating the step of inserting a unitized lubricant element in the shot sleeve;

FIG. 2 is a cross-sectional view similar to FIG. 1 but illustrating crushing of the lubricant element and spraying of the lubricant into the die cavity;

FIG. 3 is a similar cross-sectional view illustrating pouring of molten casting metal into the shot sleeve;

FIG. 7 is a side view of a prior art unitized lubricant element including a heat sealed plastic container enclosing a liquid lubricant;

FIG. 8 is a side view of an improved embodiment of container made of heat sealed plastic wherein the sealed edges are radiused;

FIG. 9 is side view of an alternative embodiment similar to FIG. 8 wherein the radiused edges of the heat sealed ends are modified;

FIG. 10 is another embodiment of heat sealed plastic container wherein the heat sealed ends are fully radiused;

FIG. 11 is a side view of an alternative embodiment of container formed from thin wall aluminum material;

FIG. 12 is an end view of the container of FIG. 11 illustrating its cylindrical configuration;

FIG. 13 is a side view of a pellet of compacted flowable semi-solid lubricant forming a non-containerized unitized lubricant element.

DETAILED DESCRIPTION OF THE INVENTION

Figure 4:
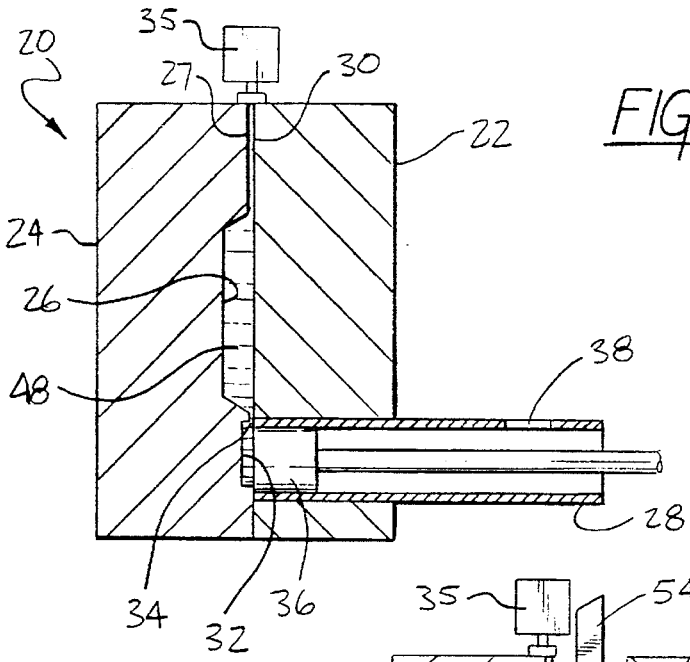
FIG. 4 is a similar cross-sectional view illustrating forcing of the molten metal into the die cavity.

Referring first to FIGS. 1–6 of the drawings in detail, numeral 20 generally indicates a die casting machine of any suitable conventional construction. Machine 20 includes a cover die 22 and an ejector die 24 forming a die pair shown in the closed position in which a die cavity 26, defined between the two dies, is enclosed within them. One or more vent passages 27 may be provided from upper portions of the cavity 26 to the exterior of the dies.

A shot sleeve 28, having the form of a cylinder, extends through the cover die 22 to an end, open to the parting line 30 which separates the two dies. In the closed position shown, the ejector die 24 blocks a substantial portion of the open end of the shot sleeve, forming, in effect, a partially closed end 32 for the shot sleeve cylinder. However, the shot sleeve cylinder 28 communicates with the die cavity 26 through a restricted passage 34 formed by a runner at the end of the shot sleeve with a gate leading directly into the die cavity 26. A vacuum valve 35 may be located to control the vent passage 27 and allow forming of a vacuum in the cavity 26 and shot sleeve 28.

In the outer end of the shot sleeve 28, there is shown a plunger 36 that is reciprocable, within the shot sleeve, from the position shown inward to a point adjacent the partially closed end 32 at the parting line between the dies. The plunger 36 acts as a ram having multiple purposes to be subsequently described.

Inward of the plunger position illustrated, the shot sleeve includes a fill opening 38. FIG. 1 illustrates the first step of a method according to the invention in which a unitized lubricant element 40 is dropped from a hand 42, or other manual or mechanical means, through the fill opening 38 into the shot sleeve 28. If desired, the plunger 36 may then be advanced to cover the fill opening 38 and a vacuum may be formed within the cavity 26 and the connecting shot sleeve 28.

FIG. 2 illustrates a following step wherein the plunger ram 36 is advanced inwardly to a point adjacent the die parting line. In the embodiment of FIG. 2, the unitized lubricant element 40 is of a type illustrated in FIGS. 7–12 wherein a flowable lubricant 44 is sealed within some form of crushable container 46. FIG. 2 illustrates an instant of the crushing step wherein the container 46 has been fully compacted by crushing, causing its walls to be broken and the lubricant 44 sprayed through the restricted passage 34 into the die cavity 26 to coat the walls of the cavity. Spraying of the lubricant over the cavity surfaces may be aided by the optional formation of a vacuum prior to delivery of the lubricant.

FIG. 3 illustrates a subsequent step in the method wherein the plunger ram 36 has again been retracted, leaving the crushed container 46 adjacent the die parting line and the surfaces of the die cavity coated with the lubricant 44. At this point, molten die casting metal 48 is poured into the shot sleeve cylinder 28 through the fill opening 38 from a ladle 50. Closing of the fill opening 38 and formation of a vacuum in the cavity 26 may then be again performed where called for by the die casting procedures.

FIG. 4 illustrates a further step in the method wherein the plunger is again advanced to a position adjacent the die parting line, forcing the molten casting metal 48 from the shot sleeve under pressure through the restricted passage 34 into the die cavity 26 in conventional fashion. The step illustrated in FIG. 4 presumes that the die casting metal is aluminum or an alloy thereof and the lubricant container 46 is also aluminum or an appropriate alloy thereof, as illustrated in FIGS. 11 and 12, or is made of a suitable plastic which is dissolvable or meltable upon contact with the molten casting metal. In either case, the crushed container is melted or evaporated by the molten aluminum and carried into the die cavity with the aluminum casting metal 48. In the case of an aluminum container, the metal of the container joins with the casting metal to form a part of the ultimate casting. In the case of a plastic container, the melted or evaporated plastic material is turned to a gas which is vented from the casting cavity through the conventional vent system, including vent 27 formed between the casting dies 22, 24.

Figure 5:
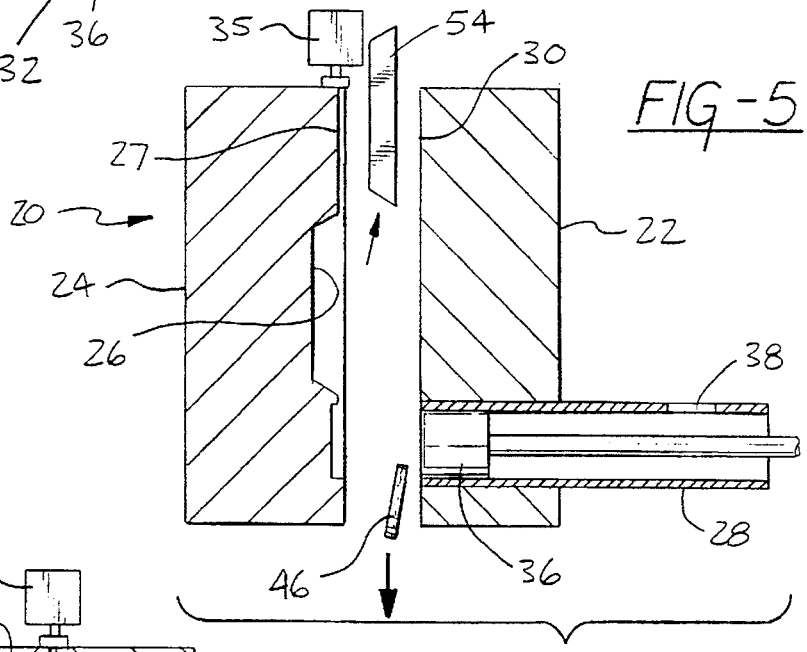
FIG. 5 is a similar cross-sectional view illustrating removal of the cast part and an optional step of removing a crushed container from the shot sleeve when the dies are open.

After the casting metal has been properly cooled, the dies are opened by movement of the ejector die leftward as shown in FIG. 5. At this point, the finished casting 54 is removed from the die in any conventional manner. At the same time, if the lubricant container has been made from a metal or other material that does not melt or disintegrate upon contact with the molten casting metal, the crushed container 46 may be removed from the end of the shot sleeve cylinder by any suitable means. This would include removing the container by tongs or other tools extended between the casting dies or, as illustrated, moving the plunger ram 36 further inward to dislodge the crushed container 46 and cause it to drop from, or be removed from, its position in the end of the shot sleeve. Alternatively the crushed container, or portions thereof, may be included in or connected with the runner portions of the cast metal that are removed with the casting 54.

Figure 6:
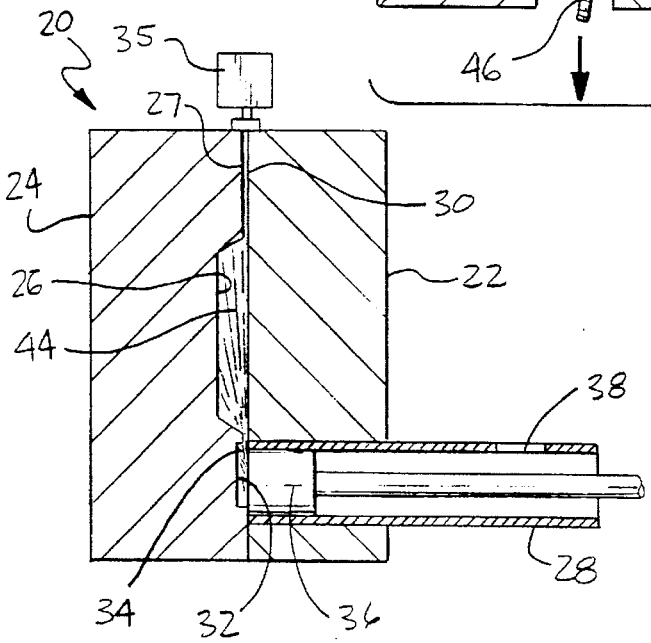
FIG. 6 is a similar cross-sectional view illustrating an alternative step of compression and spraying of a unitized pellet of flowable lubricant formed without a container.

FIG. 6 illustrates yet another optional step in place of that illustrated in FIG. 2. In FIG. 6, it is assumed that the unitized lubricant element placed in the shot sleeve is made without a container from a pelletized lubricant having the capability of freely flowing upon compression. FIG. 6 then shows the compression of such a pelletized lubricant element which is completed by advancing the plunger ram 36 to the partially closed end 32 at the die parting line, forcing the lubricant to flow or be sprayed upwardly into the die cavity 26 as illustrated, thereby coating the die cavity with the lubricant.

FIGS. 7–13 illustrate various forms of unitized lubricant elements that could be used in practice of the invention. FIG. 7 illustrates a prior art plastic container 56 formed of tubular PVC material which is heat sealed straight across the opposite ends. When filled as shown with a suitable lubricant for die lubrication or die release purposes, the filled container forms a potentially useable lubricant element. However, the sharp corners 58 of the heat sealed container could interfere with movement of the element within the cylinder of the lubricating apparatus. Containers of this type filled with lubricant provided by the buyer are available from the Andrew M. Martin Company Inc. of Gardena, Calif. under the name AMCO Pillow Paks.

FIGS. 8–10 illustrate three additional embodiments of unitized lubricant elements having plastic containers filled with a suitable lubricant. In FIG. 8, the plastic container 60 is similar to that of FIG. 7 except that the corners 62 of the heat sealed ends 64 are radiused to avoid the sharp corner effect of the prior embodiment. The corner seal is merged gradually into the edge of the main body of the container as shown. FIG. 9 shows a similar container 66 in which the radiused corners 68 of the sealed ends 70 are sealed in a squared off pattern to increase the sealing effect at the corners. FIG. 10 illustrates a further modified container 72 in which the ends 74 are fully radiused and heat sealed around their entire semi-circular peripheries. In the latter case, the ease of passing the lubricant filled container through the cylinder of a lubricant delivery apparatus should be improved.

FIGS. 11 and 12 illustrate still another form of unitized lubricant element in which the container 76 is formed as a tubular closed end member made of thin wall material, such as aluminum, which is compatible with the material of the part to be cast in the associated die casting machine. The container 76 is filled with a suitable die release or die lubricant material and closed by any suitable method to form the lubricant element. This form of container is preferably used when the lubricant is to be introduced into the shot sleeve of a die casting machine so that subsequent delivery of the molten casting metal into the shot sleeve and die cavity will melt the crushed container and allow the metal to become part of the ultimate casting.

FIG. 13 illustrates a compacted pellet 78 of semi-solid lubricant material of any suitable formulation which is flowable under pressure upon impact and compression by the ram of a lubricant delivery apparatus. The unitized lubricant pellet 78 may be formed, for example, of a combination of liquid and solid lubricants combined with wax like material, capable of being formed into a shape-retaining pellet which can be handled as a unitized lubricant element. This form of lubricant element may be utilized in any form of delivery apparatus, although it is particularly suitable for use with shot sleeve feeding where the absence of a container avoids any problem of removal of the container after lubricant delivery into the die cavity.

While the foregoing types of unitized lubricant elements have been discussed in some detail it should be understood that other suitable types of unitized elements could equally well be used in the practice of methods according to the invention.

Figure 14:
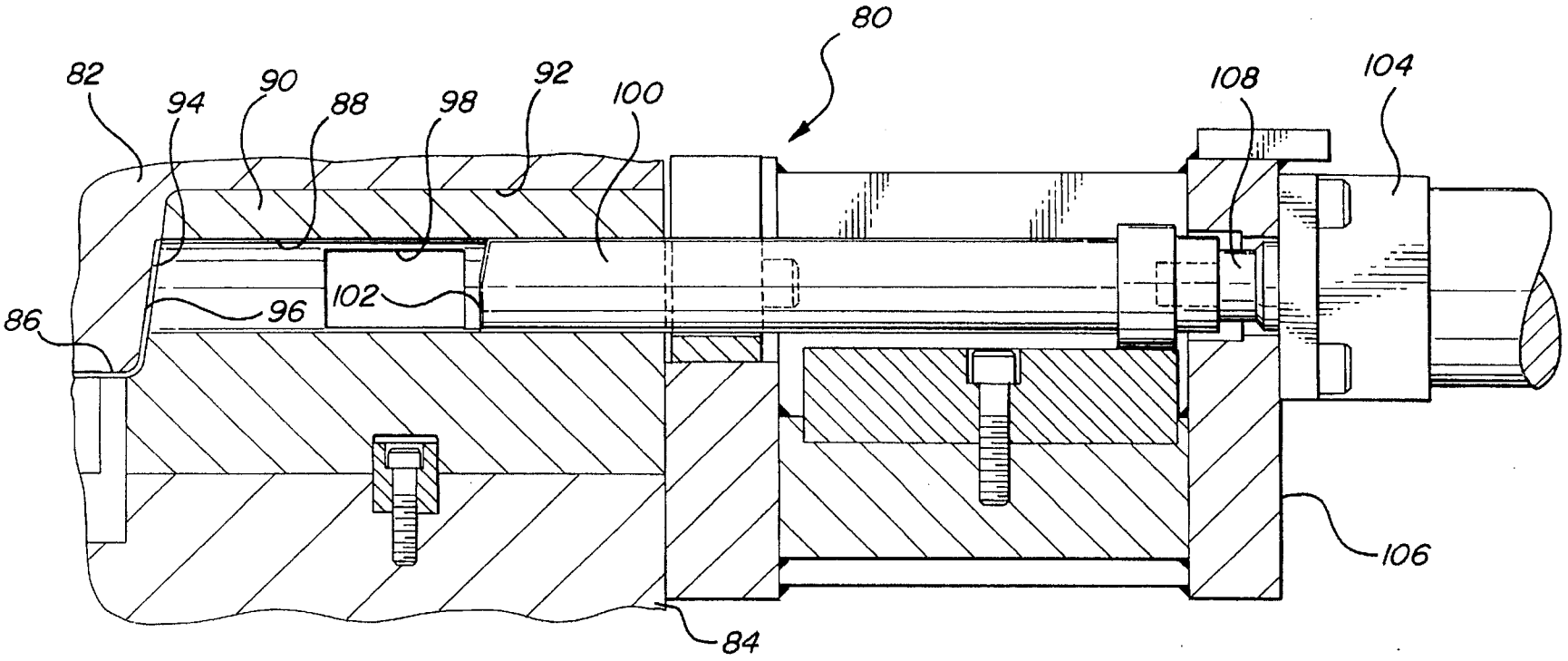
FIG. 14 is a cross-sectional view looking upward of an alternative embodiment of die lubricating apparatus incorporated in a die casting machine for delivering unitized lubricant to the die cavity.
Figure 15:
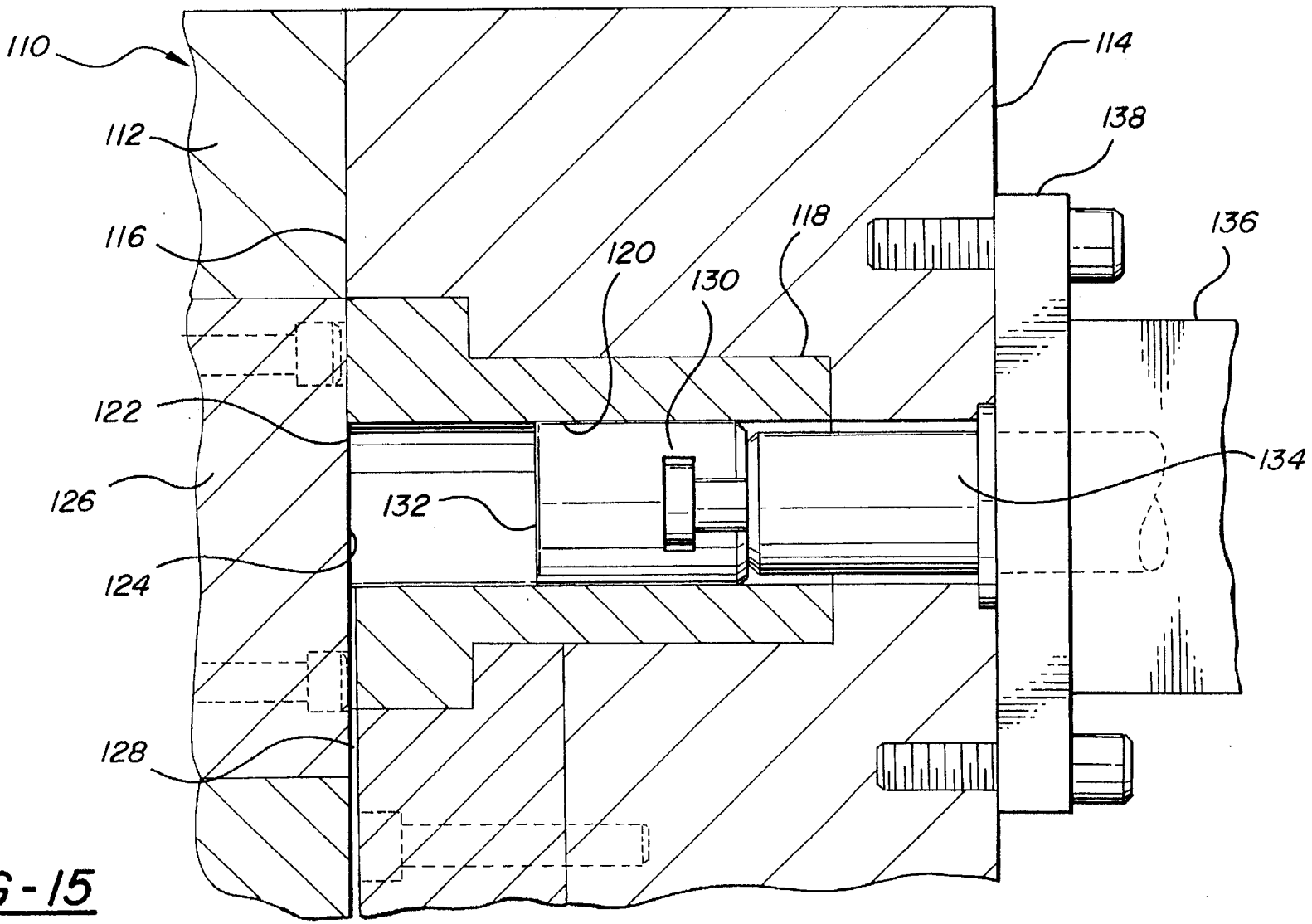
FIG. 15 is a cross-sectional view looking upward of another embodiment of die lubricating apparatus incorporated in a die casting machine for delivering unitized lubricant to the die cavity.

It is apparent that delivery of unitized lubricant elements through the shot sleeve of a die casting machine may not be the most convenient or the most efficient way in which to lubricate the casting cavity and might not be suitable for lubrication of the shot sleeve or plunger. In addition, for those instances in which a containerized lubricant element is desired, and the most available and lowest cost container material is not compatible with or meltable by the die casting molten metal, alternative forms of lubricant delivery are desirable to avoid the difficulties of removing a crushed lubricant container from the shot sleeve cylinder inner end after each casting operation. FIGS. 14 and 15 illustrate two examples of supplemental unitized lubricant delivery apparatus for use with otherwise conventional die casting machines.

FIG. 14 is an upward cross-sectional view of portions of a die casting machine 80 having a stationary cover die block 82 and a movable ejector die block 84 separated along a parting line 86. A delivery cylinder 88 extending generally parallel with the die parting line 86 is formed in an extension 90 of the ejector die block which protrudes laterally into a recess 92 of the cover die block. Cylinder 88 has an open inner end that, when the dies are closed as shown, is opposed by a wall 94 of the cover die block, in which a restricted passage 96 is formed that connects with the die cavity, not shown, located between the dies. A fill opening 98 is located in the upper side of the cylinder 88. Within the cylinder, there is a ram 100 which is reciprocable between a retracted position outward of the fill opening 98 and a forward position wherein a shaped end 102 of the ram extends into closely opposed relation with the wall 94 of the cover die block. The ram 100 may be actuated by any suitable means, such as an actuating cylinder 104 which is mounted to the ejector die by a suitable support 106 and has a shaft 108 connected directly to the ram 100.

Operation of the embodiment of FIG. 14 is generally similar to that previously described. Prior to the pouring of molten casting metal into the shot sleeve (not shown) a pelletized or containerized unitized lubricant element is placed into the cylinder 88, preferably, through the fill opening 98, when the ram 100 is retracted as shown. The ram 100 is then advanced to the inner end of its stroke, compressing the lubricant element and squirting the lubricant through the restricted passage 96 into the connected casting cavity, not shown. After performance of the casting steps previously described, the ejector die is moved away from the cover die in order to remove the finished casting as previously described. At this time, if a containerized lubricant element was used, the crushed container may be removed from the open end of the cylinder 88, which is easily accessed by the die helper as the end of the cylinder 88 has been moved outwardly, away from the wall 94 of the cover die. It is advantageous for this purpose if the cylinder and opposing wall of the cover die are located at a point of the die pair which is easily accessible to one of the operators of the casting machine.

If desired, the fill opening 98 may be omitted, and the unitized lubricant element may be inserted into the open end of the cylinder 88 before the dies are closed. In either case, the cylinder must be positioned to retain the unitized lubricant element until the dies are closed. Thus, horizontal positioning of the cylinder seems desirable. However, the cylinder may be positioned otherwise if suitable means are provided for retaining the lubricant element. For example, a spring detent could be provided near the open end of the cylinder, or the cylinder could be disposed with the open end facing slightly upward so that the lubricant element is inclined to move against the ram rather than out the open end prior to closing of the dies.

FIG. 15 illustrates another embodiment exemplary of alternative forms of lubricant delivery apparatus suitable for delivery to the die cavity of lubricant contained in unitized lubricant elements. In the figure, numeral 110 indicates a die casting machine including a cover die block 112 and an ejector die block 114, separable along a parting line 116. Within the ejector die block 114, a generally tubular insert 118 defines a cylinder 120 extending generally perpendicular to the parting line 116 and having an inner open end 122 partially closed, when the dies are closed, by an opposing wall 124 formed on an insert 126 in the cover die block 112. The partially closed end of the cylinder 120 is connected by a restricted passage 128, formed by a groove in the ejector die, with the adjacent casting cavity, not shown, formed between the dies.

A ram 130 is reciprocably mounted within the cylinder 120 and has an end face 132 that, when fully advanced, closely opposes the wall 124 of the cover die insert. When retracted, the ram provides a recess in the end of the cylinder sufficient for inserting any suitable form of unitized lubricant element as previously described. The ram may be actuated in any suitable manner, but, as shown, is driven by the shaft 134 of a direct connected actuating cylinder 136 which is mounted on a support 138 connected to the ejector die.

Operation of the embodiment of FIG. 15 is basically similar to those previously described. When the dies 112 and 114 are in an open position, wherein the ejector die 114 is laterally spaced from the cover die 112 with a gap at the parting line 116, the inner end of the cylinder 120 is open so that a unitized lubricant element may be placed therein. The ejector die 114 is then closed to sealingly engage the faces of the dies along the parting line 116. Thereafter, cylinder 136 is actuated to move the ram 130 from the retracted position shown to a forward position against, or closely spaced from, the wall 124 of the cover insert. This crushes the lubricant element, squeezing the fluid or fluidized lubricant through the restricted passage 128 into the die cavity, not shown, of the die pair. If the unitized lubricant element is of the type having a container enclosing the lubricant, the container is crushed and remains in position within the cylinder while the casting machine goes through the steps of pouring the molten casting metal and injecting it into the die cavity. After cooling of the metal, the dies are opened in order to remove the finished casting and, at the same time, the crushed container from the lubricant element may be removed from the open end of the cylinder 120. Upon retraction of the ram to the initial position shown, a new unitized lubricant element may be inserted in cylinder 120 for repetition of the cycle.

Features of unitized lubricant delivery apparatus of the sort just described and illustrated in FIGS. 14 and 15, together with other related apparatus, are described and claimed in my copending U.S. patent application Ser. No. 08/567,422 filed contemporaneously herewith.

Instead of incorporating the cylinder and ram within the dies of a die casting machine, these elements may be enclosed in a separate body, or bodies, mounted externally of the machine in various possible locations, as required to lubricate the die cavity, shot sleeve or ram as desired. Examples of such arrangements are illustrated in FIGS. 16–19.

Figure 16:
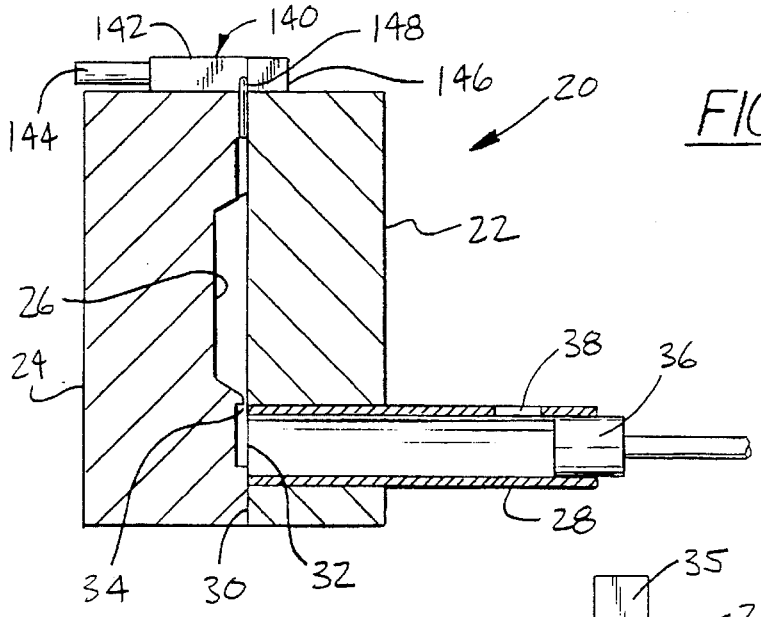
FIG. 16 is a schematic cross-sectional view of a conventional die casting machine modified to show the application of yet another embodiment of die lubricating apparatus.

FIG. 16 shows schematically a die casting machine 20 including the standard elements of the machine described with respect to FIG. 1 and indicated by common reference numerals. Mounted upon the top of the dies 22,24 is a unitized lubricant delivery unit 140. Unit 140 includes a first body member 142 mounted upon the ejector die 24 and internally including a delivery cylinder carrying a ram, not shown. These may be, for example, of the type described with respect to the embodiment of FIG. 15 but are carried externally of the die 24. Body member 142 also carries an actuating cylinder 144 for reciprocating the internal ram within the cylinder. A second body member 146, mounted upon the cover die 22, closes the end of the internal cylinder and provides a restricted passage connecting the internal cylinder through connecting means 148 with the die cavity 26.

The operation of this unit 140 is the same as those previously described. The first body member 142 moves away from the second body member 146 upon opening of the ejector die 24 so that a crushed container may be removed from the internal cylinder and a unitized lubricant element may be inserted within the internal cylinder in body member 142. If desired, a fill opening, not shown, can be divided in the top of the body member 142 for inserting a unitized lubricant element.

Figure 17:
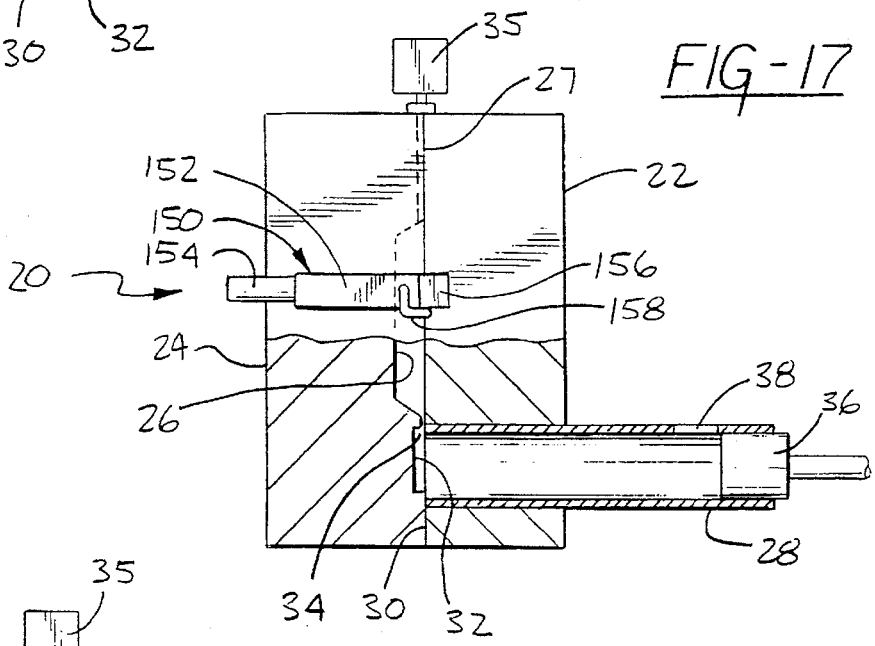
FIG. 17 is a cross-sectional view similar to FIG. 16 but showing an alternative placement of the die lubricating apparatus.

FIG. 17 illustrates an arrangement similar to FIG. 16 but in which a unitized lubricant delivery unit 150 is mounted along one side of the die pair. Unit 150 similarly includes a first body member 152 mounted upon the ejector die 24 and carrying an actuating cylinder 154 driving an internal ram reciprocable in an internal cylinder, neither of which is shown. The second body member 156 is carried on the cover die 22 and defines a restricted passage connected through connecting means 158 with the die cavity 26. This unit operates in essentially the same manner as that of FIG. 16.

Figure 18:
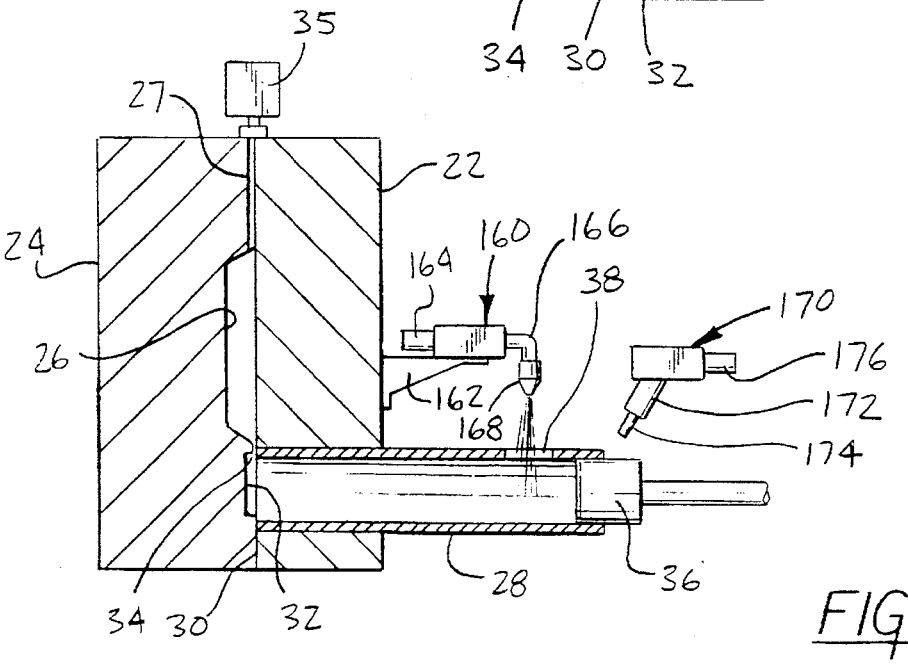
FIG. 18 is a similar cross-sectional view illustrating other arrangements for placement of die lubricating apparatus according to the invention.

FIG. 18 illustrates still another arrangement for a conventional die casting machine 20 where separate unitized lubricant delivery units are provided for lubricating the shot sleeve 28 and plunger 36. A first delivery unit 160 is carried by a bracket 162 mounted on the cover die 22. Unit 160 includes an internal cylinder with a ram driven by an actuating cylinder 164 and connects through a restricted internal passage and connecting means 166 with a nozzle 168. The nozzle sprays flowable lubricant through the fill opening 38 of the shot sleeve when the unit 160 is actuated in order to provide lubricant to the shot sleeve. A second delivery unit 170, externally mounted on means not shown, connects through connecting means 172 with a nozzle 174 for applying lubricant directly to the plunger 36 of the shot sleeve an actuating cylinder 176 actuates a ram within an internal cylinder in unit 170 to deliver the unitized lubricant as before. Openings, not shown, may be provided in the upper portions of delivery units 160 and 170 in order to allow installation of unitized lubricant elements to the cylinders of the respective units. If desired, the units 160,170 may have movable end portions similar to those previously described so that one portion may be moved away from the end of the internal cylinder and allow the insertion of a unitized element lubricant and the removal of a crushed lubricant container, if needed. If the units are made without such provision, it would be desirable to use pelletized lubricant units so that removal of a container is not required.

Figure 19:
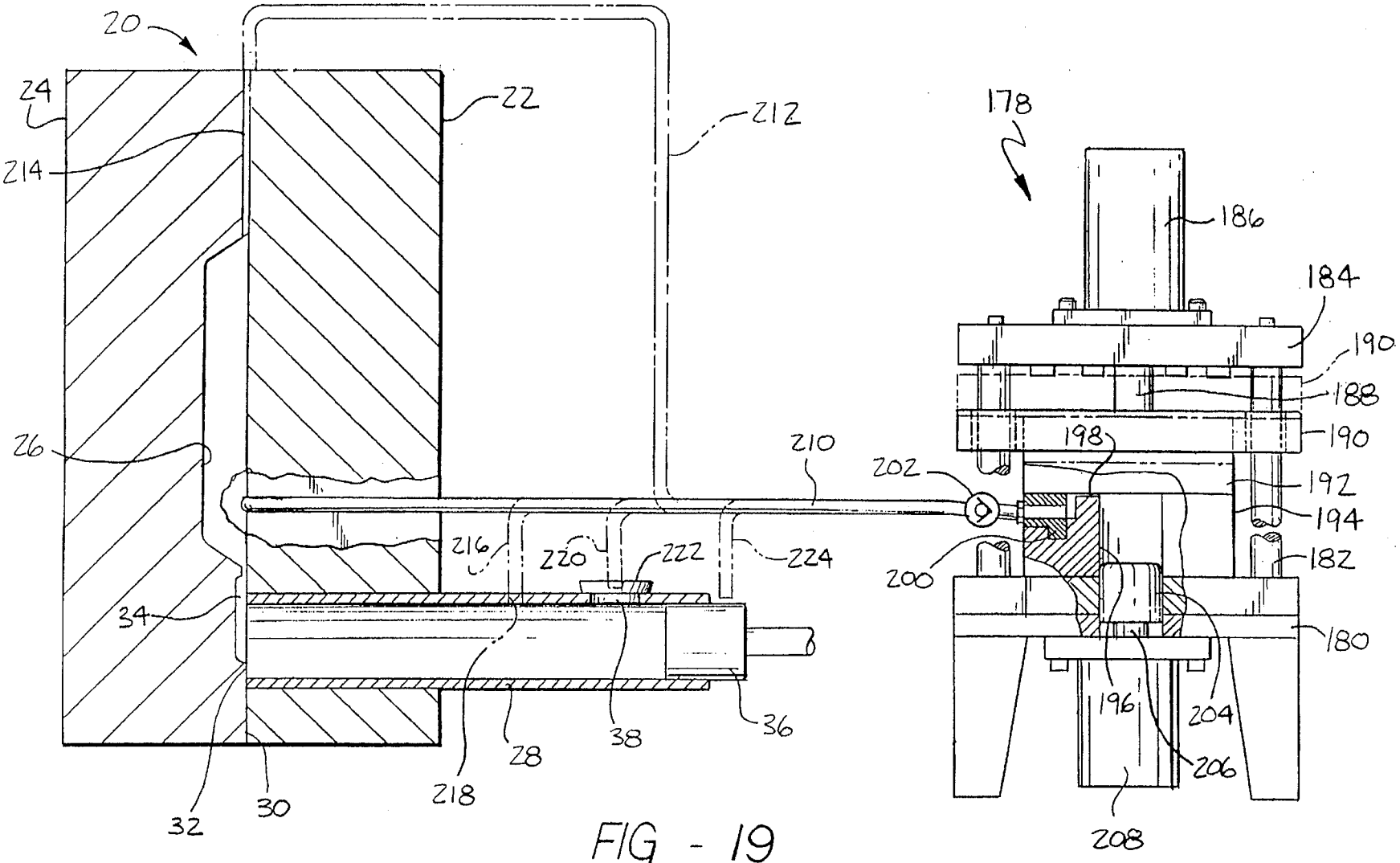
FIG. 19 is a semi-schematic partially cross-sectional view showing lubrication of a die casting machine from a separate self-contained lubricating apparatus.

FIG. 19 illustrates yet another arrangement wherein a conventional die casting machine 20 is connected with an exemplary embodiment of a self-contained unitized lubricant delivery apparatus generally indicated by numeral 178. The die casting machine 20 includes a stationary cover die 22 and a movable ejector die 24. When closed, the dies enclose an internal die cavity 26 defined by opposing walls of the dies including a recess in at least one die. The opposing die walls are separable generally along a parting line 30.

Within the stationary die 22, a shot sleeve 28 extends through to a partially closed end 32 formed by a wall on the opposing die at the parting line 30. The shot sleeve 28 extends outward of the stationary die to an opposite end near which a fill opening 38 is provided for admitting a charge of molten die casting metal during operation of the die casting machine. A plunger 36 is reciprocably movable within the shot sleeve for forcing the die casting metal into the die cavity 26 when the dies are closed, as shown. The partially closed end of the shot sleeve is connected with the die cavity 26 through a runner and gate which form a restricted passage 34 through which the molten metal is forced from the interior of the shot sleeve into the die cavity 26.

In order to provide lubrication where needed in the die casting machine 20 as, for example, in the die cavity 26, shot sleeve 28 and on the plunger 36, the free standing self-contained lubricant delivery apparatus 178 is provided. This apparatus includes a support 180 carrying guide posts 182 which in turn support a top plate 184. Plate 184 carries an actuating cylinder 186 having a rod 188 that is attached to a carrier place 190. The carrier plate 190 is movable vertically by the actuating cylinder 186 and guided by the guide posts 182. A reaction body or block 192 is mounted to the lower side of the carrier plate 190. A cylinder body 194 is mounted to the top of the support 180 and includes an upwardly open ended delivery cylinder 196 which is partially closed by a lower wall of the block 192 when the carrier plate is in its lowest position. The partially closed end of cylinder 196 connects through a restricted passage 198 with an outlet fitting 200 which, in turn, connects with an external check valve 202.

Within the cylinder 196, a ram 204 is reciprocably movable from the retracted position shown to an advanced position closely adjacent the block 192 which closes the end of the cylinder. The ram is attached to an actuating rod 206 of an actuating cylinder 208 mounted below the support 180 for moving the ram between its two positions.

In order to lubricate the die casting machine, the check valve 202 is connected with a hydraulic conduit 210 of any suitable type such as a pipe, tube or hose. Conduit 210, as shown by solid lines, is illustrated as connecting with the die cavity 26 through an opening and passage, not shown, extending along the die parting line from one side of the pair of dies. Obviously, many alternative points of connection to lubricant requiring locations of the die casting machine could be made. Some of these are illustrated by dashed lines.

For example, conduit 212 is shown connecting with the die parting line along the upper surface of the dies and through an internal passage 214 with the die cavity 26. Conduit 216 connects with the shot sleeve 28 through a special opening 218 provided in its upper surface. Conduit 220 connects with the shot sleeve 28 through the fill opening 38 provided for admitting molten metal. A plug 222 is provided at the end of conduit 220 for closing the fill opening during injection of the lubricant. An external mechanism, not shown, would be required to move the plug and conduit (hose) from the fill opening in order to allow the subsequent admission of molten metal for the die casting process. Conduit 224 is positioned to deliver lubricant directly to the exterior of the plunger 36, when in its retracted position. This conduit 224 could be provided with a small nozzle, not shown, to limit the amount of lubricant delivered. Obviously, lubricant delivery could be restricted to one of the delivery points shown or to several of them at the same time, if desired. Other suitable locations for delivering lubricant could be utilized if desired.

In operation, the carrier plate 190 is raised to the upper position shown by phantom lines in the FIG. 19 so that the upper end of the cylinder 196 is accessible for inserting a unitized lubricant element therein. Carrier plate 190 is then lowered by the actuating cylinder 186 so that the end of the delivery cylinder 196 is closed by the block 192. Actuating cylinder 208 is then actuated to drive the ram 204 upward against the unitized lubricant element, squeezing the liquid or flowable lubricant out through the restricted passage 198 and outlet fitting 200. From the fitting, lubricant passes through conduit 210, and/or any of the alternative conduits 212, 216, 220, and 224, to lubricate the selected portions of the die casting machine requiring lubrication. After a subsequent casting operation of the die casting machine, or during it if desired, the carrier plate 190 is again raised by cylinder 186 and, if a crushable lubricant container was used, the crushed container is removed from the end of the delivery cylinder 196. The ram 204 is then lowered by cylinder 208 to the position shown ready for insertion of another unitized lubricant element and repetition of the process.

Features of self-contained unitized lubricant delivery apparatus as described above and illustrated in FIG. 19 are described and claimed in my copending U.S. patent application Ser. No. 08/567,423 filed contemporaneously herewith.

When the described methods are used with die casting machines in which a vacuum valve and a connecting vacuum source, not shown, are provided for forming a vacuum in the die cavity prior to injecting casting metal therein, vacuum will preferably also be provided after closing of the dies and prior to the delivery of lubricant to the cavity. This will minimize any interference of air in the cavity with the spraying of the lubricant onto the cavity walls.

While the invention has been described by reference to various specific methods and embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method of lubricating a die cavity of a die casting machine, said die cavity formed in and separable at a parting line between a pair of die casting dies movable between closed and open positions, said machine associated with unitized lubricant delivery means including a delivery cylinder and a restricted passage connecting a partially closed end of the cylinder with said die cavity, and a ram in the cylinder and reciprocable between a first position near said end and a second position spaced from the end, said method characterized by:

inserting a unitized lubricant element including flowable lubricant into said cylinder when the ram is retracted;

drawing a vacuum in said die cavity; and advancing the ram to the first position and against the lubricant element to squeeze the element against the end of the cylinder and force the lubricant to flow through the restricted passage to said die cavity.

2. A method as in claim 1 characterized in that said die cavity connects with a shot tube and said vacuum is also drawn in the shot tube.

3. A method as in claim 2 characterized in that said lubricant delivery means is connected with said die cavity through said shot tube.

4. A method of lubricating a lubricant requiring portion of a die casting machine having a die cavity formed in and separable at a parting line between a pair of die casting dies movable between closed and open positions, said machine associated with unitized lubricant delivery means including a delivery cylinder and a restricted passage connecting a partially closed end of the cylinder with said lubricant requiring portion, and a ram in the cylinder and reciprocable between a first position near said end and a second position spaced from the end, said method characterized by:

inserting a unitized lubricant element including flowable lubricant into said cylinder when the ram is retracted; and advancing the ram to the first position and against the lubricant element to squeeze the element against the end of the cylinder and force the lubricant to flow through the restricted passage to said lubricant requiring portion.

5. A method as in claim 1 characterized in that said lubricant requiring portion is said die cavity and said step of advancing the ram is performed prior to introducing molten casting metal into said cavity.

6. A method as in claim 1 characterized in that said lubricant requiring portion is a shot sleeve connecting with said die cavity and said step of advancing the ram is performed prior to introducing molten casting metal into said shot sleeve.

7. A method as in claim 1 characterized in that said lubricant requiring portion is a plunger operable in a shot sleeve connecting with said die cavity.

8. A method as in claim 1 characterized in that said cylinder is a shot sleeve for receiving molten casting metal, said ram is a plunger for forcing the molten casting metal into the die cavity, and said step of advancing the ram is performed prior to introducing molten casting metal into the shot sleeve.

9. A method as in claim 1 characterized in that said cylinder is associated with one of said dies and said partially closed end is associated with the other of said dies, such that said end moves away from the cylinder when the dies are moved to said open position, leaving an inner end of the cylinder open for inserting said lubricant element.

10. A method as in claim 9 characterized in that said cylinder is incorporated in one of said dies.

11. A method as in claim 9 characterized in that said lubricant element includes a flowable lubricant enclosed within a crushable container and said container is crushed by movement of the ram against the lubricant element;

said method further including removing the crushed container from said cylinder through said inner end.

12. A method as in claim 1 characterized in that said cylinder is formed in a separate body associated with said machine and said restricted passage connects with said lubricant requiring portion through connecting means.

13. A method as in claim 1 characterized in that said cylinder is formed in a separate self-contained apparatus and is connected through said restricted passage and a hydraulic conduit with said lubricant requiring portion of said machine.

14. A method as in claim 1 characterized in that said unitized lubricant element is a semi-solid pellet which is flowable when crushed with the ram.

15. A method as in claim 1 characterized in that said unitized lubricant element includes a flowable lubricant enclosed within a crushable container.

16. A method as in claim 15 characterized in that said flowable lubricant is a liquid.

17. A method as in claim 15 characterized in that said flowable lubricant is a composite including solid and liquid lubricants.

18. A method as in claim 1 characterized in that said lubricant element includes a flowable lubricant enclosed within a crushable container and said container is crushed by movement of the ram against the lubricant element;

said method further including removing the crushed container from said cylinder.

19. A method as in claim 18 characterized in that said cylinder is a shot sleeve and said container is formed of a meltable material compatible with said casting metal and is removed by melting and merging with the casting metal upon forcing of said molten casting metal from the shot sleeve into the die cavity.

20. A method as in claim 18 characterized in that said cylinder is a shot sleeve and said container is formed of a heat vaporizable material and is removed by vaporization and escape through die vents upon forcing of said molten casting metal from the shot sleeve into the die cavity.

* * * * *